United States Patent [19]

Silvia

[11] Patent Number: 5,022,326

[45] Date of Patent: Jun. 11, 1991

[54] ASYNCHRONOUS EXPLOSIVE LOGIC SAFING DEVICE

[75] Inventor: Denis A. Silvia, Aberdeen, Md.

[73] Assignee: The United States of America as represented by the Secretary of the Navy, Washington, D.C.

[21] Appl. No.: 380,204

[22] Filed: May 20, 1982

[51] Int. Cl.[5] ..... F42D 1/04; F42B 3/10

[52] U.S. Cl. ..... 102/275.9; 102/305; 102/701

[58] Field of Search ..... 102/202, 202.1, 221, 102/222, 215, 275.1, 275.2, 275.3, 275.4, 275.5, 275.6, 275.7, 275.8, 275.9, 276, 305, 475, 701; 340/815.31

[56] References Cited

U.S. PATENT DOCUMENTS

| | | | |
|---|---|---|---|
| 3,035,518 | 5/1962 | Coursen | 102/305 |
| 3,430,564 | 3/1969 | Silvia et al. | 102/275.9 |
| 3,496,868 | 2/1970 | Silvia et al. | 102/305 |
| 3,669,021 | 6/1972 | Spencer et al. | 102/701 X |
| 3,753,402 | 8/1973 | Menz et al. | 102/701 X |
| 3,768,409 | 10/1973 | Menz et al. | 102/275.9 |
| 3,820,461 | 2/1974 | Silvia | 102/305 |
| 3,973,499 | 8/1976 | Anderson et al. | 102/701 X |
| 4,104,618 | 8/1978 | Towsend | 340/815.31 X |

*Primary Examiner*—David H. Brown

*Attorney, Agent, or Firm*—John D. Lewis; Kenneth E. Walden

[57] ABSTRACT

An asynchronous explosive logic safing device which is mappable as a network on a single surface to perform the safe/arming function for an explosive device or warhead. The safing device uses explosive logic AND gates and AND/OR gates in conjunction with a complex logic gate to form an asynchronous network that absorbs the variation in detonator input signals and only propagates the detonation signal to the warhead when a given number of a set of detonators initiate.

16 Claims, 4 Drawing Sheets

ASYNCHRONOUS EXPLOSIVE LOGIC SAFING DEVICE

BACKGROUND OF THE INVENTION

Many ordnance devices, such as projectiles, mines or bombs, require a fuze to detonate the device at the desired place and time. An important part of the fuze is the safety and arming device (S/A), which contains a group of explosive components called an explosive train. The explosive train may be in an out-of-line (safe) position or in an in-line (armed) position. When in the safe position, accidental initiation of any of the elements of the explosive train must not lead to detonation of the weapon. Conversely, when in the armed position, initiation of the explosive train must always lead to detonation of the weapon.

Prior art methods of safe/arming an explosive device consist of using mechanical devices or exploding bridgewire devices. The mechanical safe/arming devices physically interpose a barrier between the detonator explosive charge and the main charge of the weapon. Mechanical devices have several drawbacks in that environmental degradation over an extended storage period results in an increased failure rate. In addition, as weapon designs become more complex, the requirements placed on mechanical safe/arming devices have resulted in clockwork mechanisms which are large, expensive, complex, and thus more unreliable.

Exploding bridgewire devices have no primary explosive charge in the detonator. The bridgewire device initiates the main charge by providing a tremendous pulse of high voltage current to the bridgewire which causes the bridgewire to explode. This initiates a booster which in turn initiates the main explosive charge. Because the exploding bridgewire detonator does not contain any primary explosive, the detonator may be connected directly to a booster or the main charge without the necessity of a mechanical safing mechanism. The drawback of the exploding bridgewire detonator is that it requires an expensive high voltage power supply to provide the necessary current for exploding the bridgewire. This is not generally suitable for conventional ordnance.

A more suitable method of safe/arming modern weapons systems for high reliability and safety is the use of an explosive logic network interposed between the electronically actuated detonators and a booster charge which in turn detonates the warhead. The explosive logic network, such as that disclosed in U.S. Pat. No. 4,412,493, receives an input from the detonators and performs syntactical or ordered operations to verify that a valid input combination has been received by the detonators.

In conjunction with the explosive logic network disclosed in the aforementioned patent, a synchronous explosive logic clock, such as that disclosed in patent application filed Dec. 23,1981 and Ser. No. 333,608, is utilized to open a time window during which a set of theoretically identical detonators must fire. The synchronous explosive logic clock also examines the first detonation to determine whether or not it is premature before propagating the detonation to the explosive logic network. The explosive logic clock disclosed in the aforementioned patent application No. 333,608 uses a synchronous approach to absorb the variation in theoretically simultaneous detonations necessitating extensive explosive delay paths which dominate network design. The complex path design of the synchronous explosive clock requires that the network be mapped on more than one surface. The asynchronous approach of the explosive logic safing device of the subject invention, together with the explosive delay path disclosed in patent application filed July 2, 1981 and Ser. No. 279,643, allows a safe/arming device to absorb the variation in theoretically simultaneous detonations, referred to as detonator "jitter", without resorting to complex, multi-surface network designs.

SUMMARY OF THE INVENTION

Accordingly, there is provided in the present invention a generational series of explosive logic safing devices which provide simplified networks for safe/arming an explosive device or warhead without requiring a complex synchronous explosive logic clock.

An AND gate is constructed with a detonation delay path in series with first and second explosive logic switches. The detonation delay path receives input detonation signals from first and second detonators which also generate control signals to set the first and second explosive logic switches. When both the first and second detonators initiate within the time frame of the detonation delay path, the first and second logic switches are set and an output detonation signal is propagated indicating that both the first and second detonator initiated. The AND gate is the basis for a first generation explosive logic safing device which incorporates multiple AND gates and delay paths to yield a safing device which is mappable on a single surface and propagates an output detonation signal when a given or required number of a set of detonators initiate.

An AND/OR gate is constructed with a detonation delay path in series with first and second explosive logic switches, each of which has two possible outputs. The detonation delay path receives input signals from first and second detonators which also generate control signals to select the output for each of the first and second logic switches. When both the first and second detonators initiate within the time frame of the detonation delay path, the logic switches are set to propagate a detonation signal from an AND output of the gate. When either the first or second detonators initiate, the logic switches are set to propagate a detonation signal from an OR output of the gate. The AND/OR gate is the basis for a second generation explosive logic safing device which incorporates multiple AND gates and multiple AND/OR gates to yield a simplified explosive logic network which propagates an output detonation signal when a given or required number of a set of detonators initiate.

A complex logic gate is constructed with a detonation delay path in series with a primary explosive logic switch having two selectable outputs, two secondary explosive logic switches, each of which has two selectable outputs, a tertiary explosive logic switch having two selectable outputs and an outlet explosive logic switch. The detonation delay path receives input signals from a plurality of AND/OR gates in series with a plurality of detonators. The plurality of detonators also generate control detonation signals to select the appropriate output from each logic switch. When AND input signals are furnished to the complex logic gate, a corresponding detonation output signal is propagated. When OR input signals are furnished to the complex logic gate, a second corresponding detonation output signal is generated. When a given or required number of a set of detonators initiates, a detonation output signal is generated. The complex logic gate is the basis for a third generation explosive logic safing device having an extremely simplified logic network which propagates an output detonation signal when a given or required number of a set of detonators initiate.

OBJECTS OF THE INVENTION

It is an object of the present invention to provide an explosive logic safing device for safe/arming an explosive charge or warhead.

Another object of the present invention is to provide an asynchronous explosive logic network for safe/arming an explosive charge or warhead.

Another object of the present invention is to provide an asynchronous explosive logic safing device which is inexpensive to manufacture.

A further object of the present invention is to provide an asynchronous explosive logic safing device which is compact and mappable on a single plane.

A still further object of the present invention is to provide an explosive logic safing device that does not require multi-surface mechanical interfaces.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages therein will be readily understood by reference to the following detailed description when considered with the accompanying drawings in which like reference numerals and letters designate like parts throughout the figures and wherein.

DESCRIPTION OF THE PREFERRED EMBODIMENT

Figure 1A:
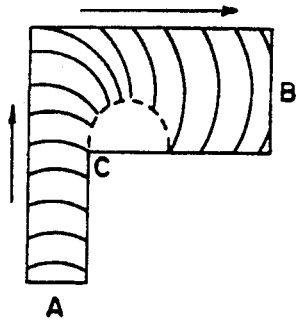
FIG. 1a PRIOR ART
FIGS. 1*a, b,* and *c* illustrate the corner effect in an explosive trail.
Figure 1B:
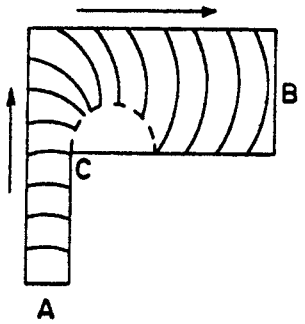
FIG. 1b PRIOR ART
Figure 1C:
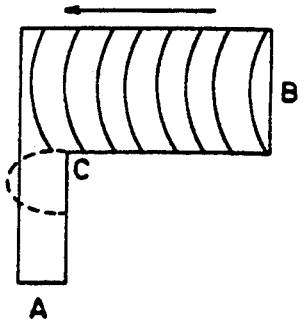
FIG. 1c PRIOR ART

Explosive logic networks for safe/arming devices of conventional and nuclear weapons are based on the "corner effect" principle discovered by Denis A. Silvia and Richard T. Ramsey of the Naval Surface Weapons Center, Dahlgren, Va. The corner effect occurs when a detonation wave propagating in an explosive sheet or trail tries to turn a sharp corner. As illustrated in FIGS. 1*a* and 1*b*, a detonation wave propagating from narrow trail A to wide trail B requires an increased width in trail B to negotiate corner C. As illustrated in FIG. 1*c*, a detonation wave propagating in an explosive trail from wide trail B to narrow trail A in negotiating corner C will turn wide around the corner and run out of room in the narrow explosive trail A and thus extinguish itself.

Figure 2A:
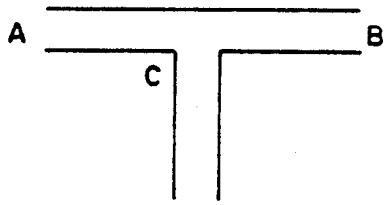
FIG. 2a PRIOR ART
FIGS. 2*a* and *b* illustrate the corner effect in a non-switched null gate.
Figure 2B:
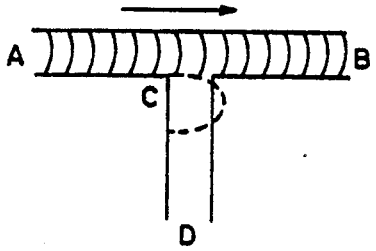
FIG. 2b PRIOR ART
Figure 3A:
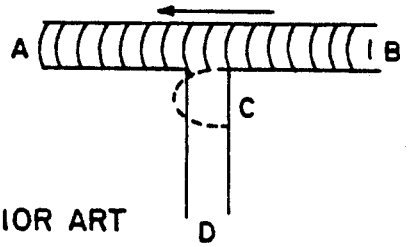
PRIOR ART FIG. 3a
FIGS. 3*a* and *b* illustrate the corner effect in a switching null gate.
Figure 3B:
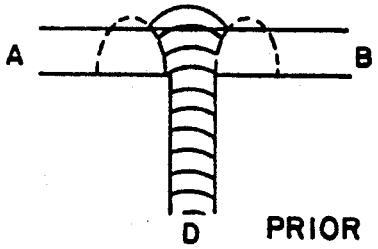
PRIOR ART FIG. 3b

The principle of the corner effect can be used to establish an explosive diode or one way switch which, in effect, is the situation depicted in FIG. 1*c*. A detonation wave propagating from trail A will be able to turn the corner and proceed on to trail B but a detonation wave initiating in trail B will not be able to negotiate corner C, will extinguish itself, and will not propagate to trail A As illustrated in FIGS. 2*a* and *b* and 3*a* and *b*, the corner effect can also be used to create a logic gate. FIGS. 2*a* and *b* illustrate a detonation wave propagating from trail A to trail B which, due to the corner effect, will not negotiate corner C and will not propagate down trail D. As illustrated in FIG. 3*a*, a detonation wave propagating from trail B to trail A will likewise not be able to negotiate corner C and thus will be preVented from propagating down leg or explosive trail D due to the corner effect. As shown in FIG. 3*b*, however, the detonation wave initiating in trail D will propagate to the intersection of trails A and B and will never trails A and B and, again due to the corner effect, extinguish itself and not propagate down either trail A or trail B. The logic device described in FIG. 3*b* can be referred to as an explosive null gate. A detonation wave proceeding down trail D will disrupt trails A and B prior to a detonation wave passing along trails A and B and thus prevent passage of the detonation wave from trail A to trail B. In addition, the corner effect will prevent the detonation wave in trail D from turning into either trail A or trail B.

Figure 4:
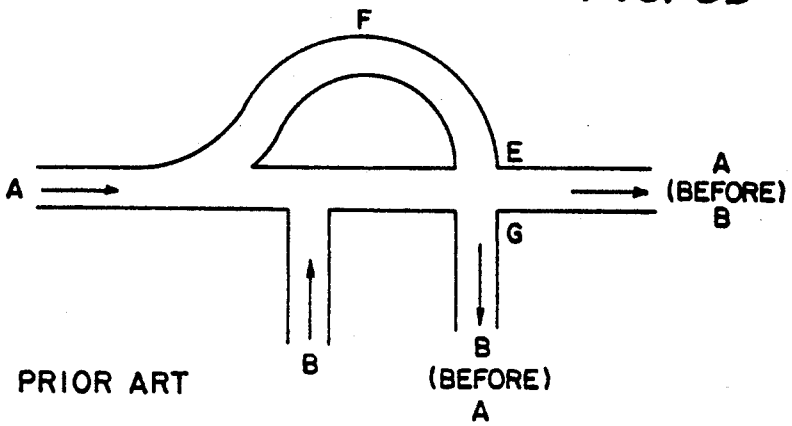
PRIOR ART FIG. 4
FIG. 4 illustrates an explosive logic switch.

The principle of the corner effect, as embodied in the explosive logic null gate of FIG. 3, can be utilized in an explosive logic switch device illustrated in FIG. 4. A detonation wave initiated in trail A prior to the initiation of a detonation wave in trail B (A before B) will result in the wave proceeding down trail and into outlet trail E. However, if a detonation wave is initiate in trail B of FIG. 4 prior to the initiation of a detonation wave in trail A (B before A), then the detonation wave in trail B will sever trail A at the null gate thus preventing passage of the detonation wave down A to E. Instead, the detonation wave will proceed on explosive loop F, thus bypassing the severed null gate, and proceed down outlet trail G. The detonation wave proceeding through loop F will proceed down trail G and not turn into trail E because of the corner effect. The incorporation of the corner effect, by means of the null gate in the explosive switch illustrated in FIG. 4, provides a logic switch for choosing between two possible sequences of events.

Typical safing systems used in conventional and nuclear warhead applications incorporate both electrical safing and mechanical safing or exploding bridgewire detonator devices. The electrical safing device ensures that a false electrical pulse is not sent to the warhead detonator. The second safing device, such as an explosive logic safing device of secondary explosive imprinted on or grooved in an inert disc, protects the warhead from accidental detonation due to improper functioning of a given detonator, whether from electrical or other causes. The explosive logic safing device is a pattern of explosive trails which are formed in a network on the inert disc with secondary explosive which due to its characteristics does not require safing. The input to the explosive logic safing device is provided by a set of detonators. When the correct detonator input is supplied to the explosive logic safing device, i.e., the required number of detonators in a set initiate, a control detonation signal is propagated through the safing device and on to a booster charge and the main explosive charge or warhead. If the required number of a set of detonators fail to detonate, the explosive logic safing device extinguishes the control detonation signal before it can reach the warhead.

Figure 5:
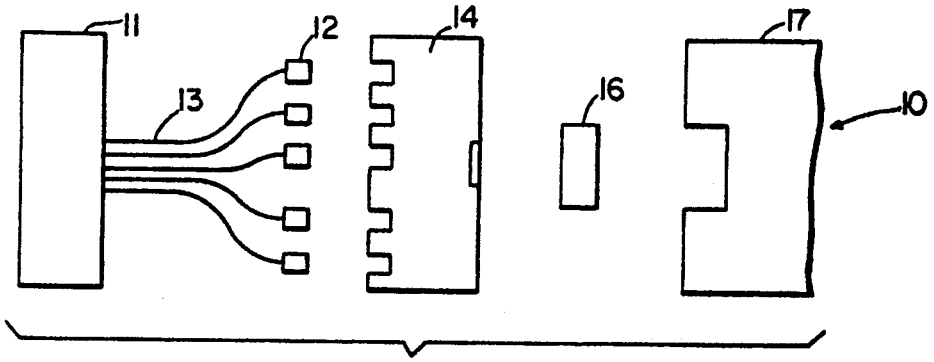
FIG. 5 PRIOR ART
FIG. 5 illustrates how a safe/arm device with the asynchronous explosive logic network of the subject invention can be incorporated into a missile or other system.

FIG. 5 illustrates the explosive logic safing device of the subject invention incorporated in a safe/arming device 10. The safe/arming device is provided with safe/arming electronics 11 which provide electrical detonation signals by means of electrical conductors 13 to a set of detonators 12. The detonators are positioned in explosive logic safing device 14 which is constructed of explosive trails on or in an inert disc. The output of the explosive logic safing device is used to initiate a booster charge 16 which in turn detonates the primary explosive charge or warhead 17.

Figure 6:
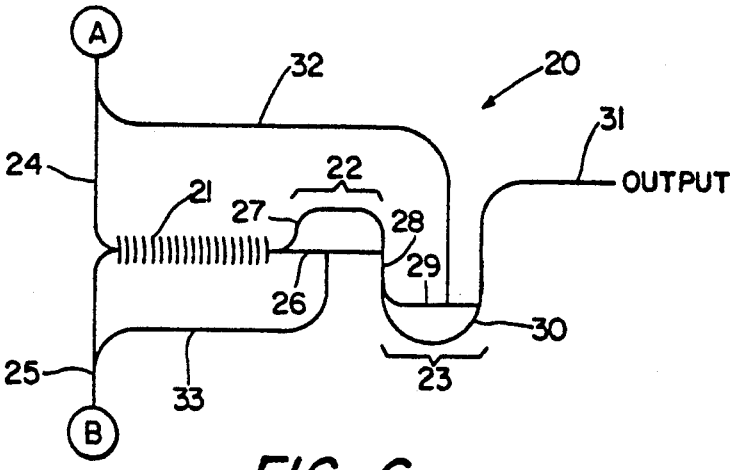
FIG. 6 illustrates an explosive logic AND gate.

Referring to FIG. 6, there is illustrated in schematic form a distributed logic AND gate 20 which generates an output detonation signal when provided with properly timed detonation signals from detonators A and B. The AND gate is constructed with detonation delay path 21 in series with a first explosive logic switch 22 and a second explosive logic switch 23. Detonator A is connected to delay detonation path 21 by an input explosive trail 24 while detonator B is connected to detonation delay path 21 by input explosive trail 25. Delay detonation path 21 may be a delay such as that disclosed in the aforementioned copending patent application No. 279,643.

As shown in FIG. 6, first explosive logic switch 22 is constructed with a straight explosive trail 26 and an explosive loop 27 which diverges from and then reintersects trail 26 and then bifurcates at 28 and leads into second explosive logic switch 23 which is in series with first logic switch 22. A first branch of bifurcation 28 leads into straight explosive trail 29 of the second logic switch while the second branch of bifurcation 28 leads into explosive loop 30, which is intersected by trail 29, and then leads into output trail 31.

Detonator A is provided with a control explosive trail 32 which intersects straight trail 29 and controls the output of the second logic switch while detonator B is provided with control explosive trail 33 which intersects straight trail 26 and controls the output of the first logic switch.

In operation, assuming that detonator A initiates before detonator B, although the reverse sequence is also possible, a detonation signal is propagated simultaneously in input explosive trail 24 and control explosive trail 32. The detonation signal in input trail 24 enters detonation delay path 21 while the detonation signal in control trail 32 intersects and severs straight trail 29 of second logic switch 23 thus setting the switch for detonation propagation only in explosive loop 30. The time duration that the input detonation signal is in detonation delay path 21 determines the "time window" during which detonator B must initiate.

Assuming detonator B initiates within the "time window" of delay path 21, a control detonation signal is propagated in control trail 33 to intersect and sever straight explosive trail 26 of first logic switch 22 thus setting the switch for detonation propagation only in explosive loop 27. Detonator B also propagates a redundant input detonation signal to detonation delay path 21 by means of explosive trail 25. When the input detonation signal exit detonation delay path 21, the signal propagates down explosive loop 27 of first logic switch 22 and then down explosive loop 30 of second logic switch 23 to output trail 31 thus yielding an output which signifies that both detonator A and detonator B initiated properly If detonator B fails to initiate during the "time-window", straight trail 26 is not severed by a control detonation signal in control trail 33 and when the input detonation signal exits delay path 21 it propagates down straight trail 26 to intersect and sever explosive loop 27 thus extinguishing the input detonation signal. Output trail 31 does not propagate an output signal and this signifies that detonator A and detonator B did not both initiate properly.

When detonator B initiates first, thereby setting the first logic switch, followed by the initiation of detonator A within the "time-window" of delay path 21 thereby setting the second logic switch, an output signal is propagated in outlet trail 31 signifying that both detonator A and detonator B initiated. If detonator A does not initiate within the "time-window", then second logic switch 23 remains unset and the input detonation signal is extinguished in the second logic switch, again indicating that detonator A and detonator B did not both function properly.

Figure 7:
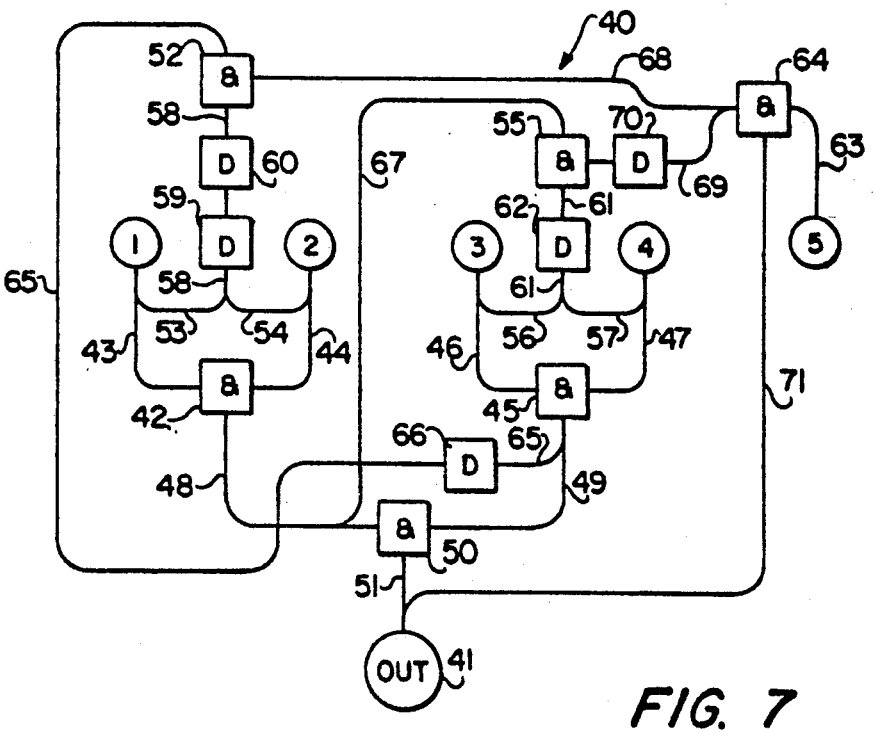
FIG. 7 illustrates a first generation explosive logic safing device of the subject invention.

The AND logic gate illustrated in FIG. 6 is used in the first generation explosive logic safing device 40, illustrated schematically in FIG. 7, which requires that a given number of a set of detonators initiate properly before the device generates an output signal at outlet 41. Device 40 is constructed with a set of five detonators illustrated by the numerals 1–5 in FIG. 7. Four of the detonators, 1, 2 and 3, 4, are positioned in pairs and designated as paired detonators while the fifth detonator is positioned separately and designated as an additional detonator.

Figure 9:
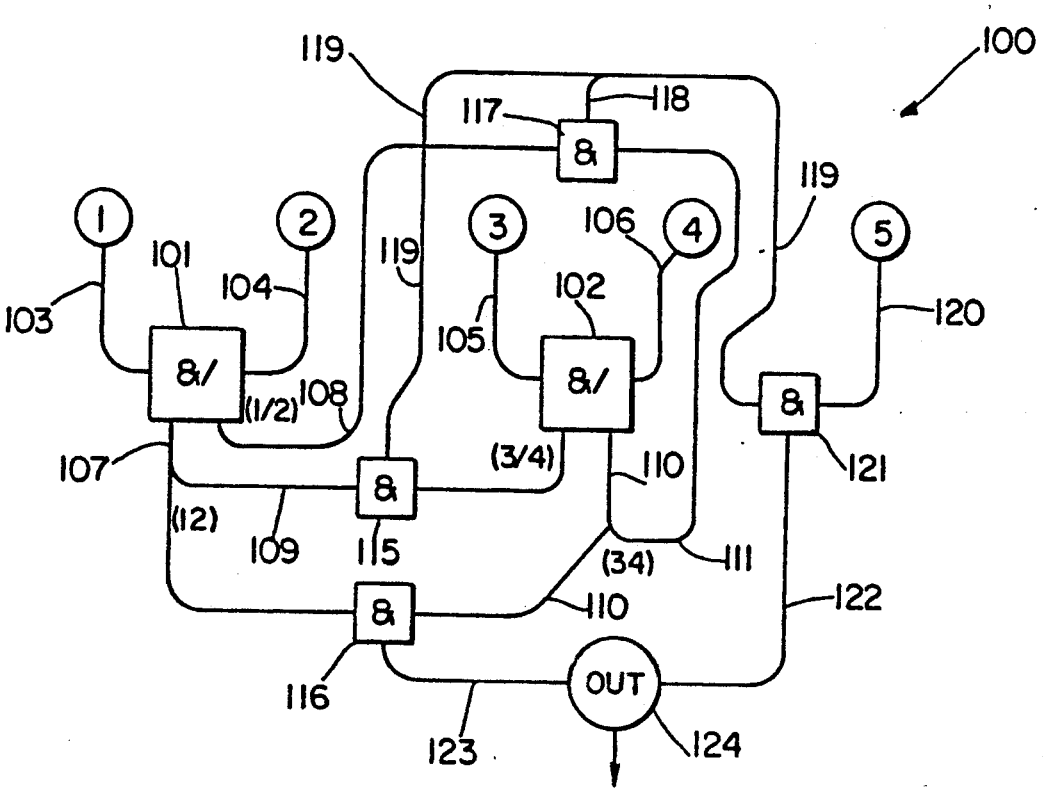
FIG. 9 illustrates a second generation explosive logic safing device of the subject invention.
Figure 11:
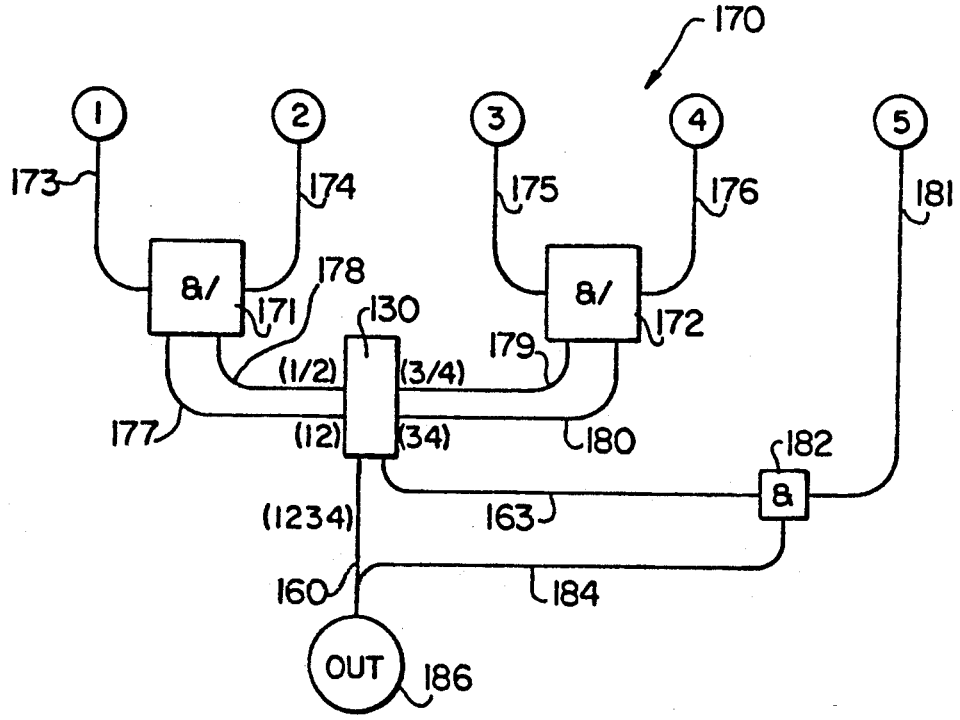
FIG. 11 illustrates a third generation explosive logic safing device of the subject invention.

As illustrated in FIG. 7, detonators 1 and 2 are connected to primary AND gate 42 by explosive trails 43 and 44, respectively, while detonators 3 and 4 are connected to primary AND gate 45 by explosive trails 46 and 47, respectively. AND gates 42 and 45 are configured as described with respect to AND gate 20 in FIG. 6. aid in illustrating the device components, AND gates in FIGS. 7, 9 and 11 are further labeled with the "&" symbol. Primary AND gate 42 is provided with an output explosive trail 48 while primary AND gate 45 is provided with output explosive trail 49. Output explosive trails 48 and 49 are connected to and provide the input for outlet AND gate 50 which is connected in series with primary AND gates 42 and 45. Outlet AND gate 50 is provided with an outlet explosive trail 51 which connects AND gate 50 in series with outlet 41.

As shown in FIG. 7, safing device 40 is also provided with secondary AND gate 52, connected by explosive trails 53 and 54 to detonators 1 and 2, respectively, and secondary AND gate 55, connected by explosive trails 56 and 57 to detonators 3 and 4, respectively. Secondary AND gate 52 is connected in series with detonators 1 and 2 but is connected in parallel with primary AND gate 42. Secondary AND gate 55 is connected in series with detonators 3 and 4 but is connected in parallel with primary AND gate 45.

Explosive trails 53 and 54 join to form trail 58 which provide an input for secondary AND gate 52. Explosive trail 58 is provided with detonation delays 59 and 60 which afford detonation timing to safing device 40. To aid in illustrating the device components, detonation delays in FIG. 7 are further labeled with the "D" symbol. Explosive trails 56 and 57 join to form explosive trail 61 which provides an input for secondary AND gate 55. Explosive trail 61 is provided with detonation delay 62 which again aids in the detonation timing of safing device 40. It is to be understood that detonation delays such as that shown at 59, 60 and 62 can be interposed as desired throughout safing device 40 to aid in sequencing of the detonation signals.

Referring further to FIG. 7, it can be seen that safing device 40 is provided with an additional or fifth detonator, designated as detonator 5, which is connected in series by explosive trail 63 with an additional AND gate 64. Detonator 5, by means of explosive trail 63, supplies an input to additional AND gate 64.

Secondary AND gate 52 receives an input from explosive trail 58 and detonators 1 or 2 and also receives an input from explosive trail 65 which is connected to output explosive trail 49 of primary AND gate 45 so as to propagate a signal from trail 49 to trail 65. Explosive trail 65 is provided with detonation delay 66. When secondary AND gate 52 receives inputs on explosive trails 65 and 58, an output detonation signal is generated on explosive trail 68 which is connected to supply an input to additional AND gate 64.

Secondary AND gate 55 receives an input from explosive trail 61 and detonators 3 or 4 and also receives an input from explosive trail 67 which is connected to output explosive trail 48 of primary AND gate 42 so as to propagate a signal from trail 48 to trail 67. When secondary AND gate 55 receives inputs on explosive trails 61 and 67, an output detonation signal is generated on explosive trail 69 which is provided with detonation delay 70 and connected to explosive trail 68 so as to supply an input to additional AND gate 64 Additional AND gate 64 is provided with an output explosive trail 71 which is connected to output explosive trail 51 of outlet AND gate 50 so as to propagate a signal from trail 71 to trail 51.

Safing device 40, illustrated in FIG. 7, is constructed to provide a detonation signal at outlet 41 whenever four out of the five detonators initiate in the proper time frame.

Assuming that detonators 1–4 of FIG. 7 all detonate in a timely fashion, primary AND gate 42 will receive two input detonation signals from explosive trails 43 and 44, generated by detonators 1 and 2 respectively, while primary AND gate 45 will receive two input detonation signals from explosive trails 46 and 47, generated by detonators 3 and 4 respectively. With the primary AND gates each receiving two input signals, primary AND gate 42 generates a primary output signal on output explosive trail 48 while primary AND gate 45 generates a primary output signal on output explosive trail 49. The primary output signals propagated on explosive trails 48 and 49 serve as the two input signals for outlet AND gate 50 which generate an output signal on output explosive trail 51 to outlet 41 and on to the booster charge or warhead (not shown). Presentation of a detonation signal at outlet 41 signifies that at least 4 out of 5 detonators initiated properly. When detonators 1–4 detonate properly, the performance of detonator 5 is immaterial to the operation of safing device 40.

It should be noted that initiation of detonators 1–4 will also result in secondary input detonation signals being propagated in explosive trails 53, 54, 56, 57, 58 and 61 to secondary AND gates 52 and 55. However, the explosive trails to the secondary AND gates ar provided with detonation delays 59, 60 and 62 which delay the secondary input signals to the secondary AND gates thus making the secondary input signals later in time than the primary output signals to outlet AND gate 50 which will have previously generated an output signal on output exPlosive trail 51.

It should also be noted that primary AND gate 42 will generate a primary output signal in explosive trail 67 to serve as an input to secondary AND gate 55 while primary AND gate 45 will generate a primary output signal in explosive trail 65 to serve as an input to secondary AND gate 52. For secondary AND gates 52 and 55 to generate an output signal will still require an input from detonation delayed explosive trails 58 and 61, respectively, which will put the output signal from the secondary AND gates later in time than the output signal from outlet AND gate 50.

Assuming that one o the detonators 1–4 fails to initiate properly, detonator 2 for example, a detonation signal will not be generated in explosive trail 44 and thus a primary output signal will not be generated in output explosive trail 48 by primary AND gate 42. Likewise, outlet AND gate 50 will only receive a single input signal and will not generate an output signal to outlet 41.

However, the initiation of detonator 1 will generate a secondary input detonation signal in explosive trails 53 and 58 which will traverse detonation delays 59 and 60 to serve as an input to secondary AND gate 52. Assuming that detonators 3 and 4 initiate properly primary AND gate 45 will generate an output signal in explosive trail 49 which is propagated to explosive trail 65 and through detonation delay 66 to serve as a secondary input signal to secondary AND gate 52. With two secondary inputs provided by the initiation of detonators 1, 3 and 4, secondary AND gate 52 generates an output signal on output explosive train 68 which serves as an input signal to additional AND gate 64.

Assuming that detonator 5 initiates properly, an outPut detonation signal will be propagated on explosive trail 63 to serve as an input to additional AND gate 64. With additional AND gate 64 provided with an input from secondary AND gate 52, representing the proper initiation of detonators 1, 3 and 4, and an input from explosive trail 63, representing the proper initiation of detonator 5, an output signal is generated in output explosive trail 71 and propagated to outlet 41 signifying that four out of five detonators initiated properly. Outlet 41 propagates the detonation signal on to the booster charge or warhead (not shown).

Although the previous discussion assumed that detonator 2 failed to initiate properly, it is to be understood that a similar course of events will take place if any one of the detonators 1–4 fails to initiate. If more than one of the five detonators fails to initiate properly, safing device 40 will not generate an output signal at outlet 41.

Figure 8:
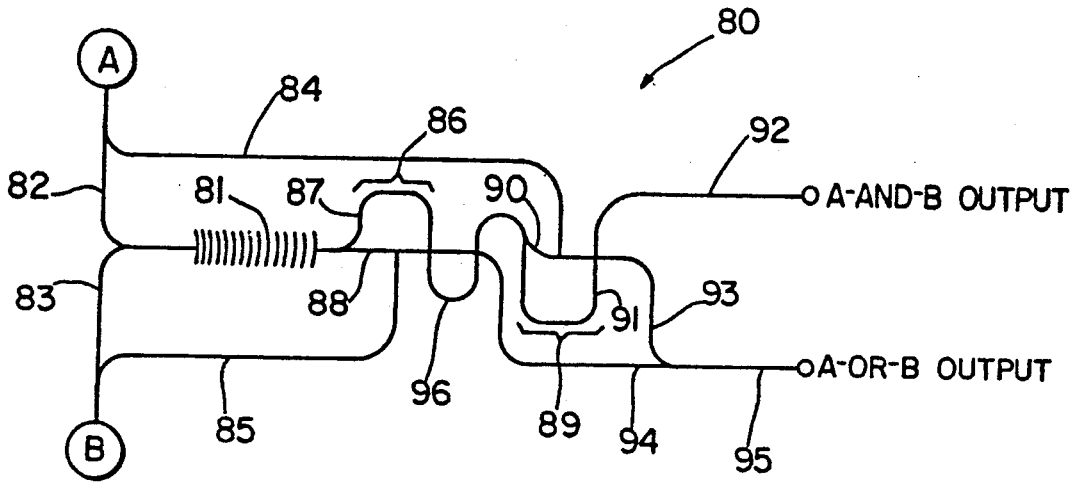
FIG. 8 illustrates an explosive logic AND/OR gate.

Referring now to FIG. 8, there is illustrated in s:hematic form an AND/OR logic gate which yields a first output when both detonators A and B initiate and yields a second output when either detonator A or B initiate.

AND/OR gate 80 is constructed with a detonation delay path 81 in series with a first explosive logic switch 86 and a second logic explosive switch 89. Detonation delay path 81 receives input detonation signals from detonators A and B, with detonator A connected to the delay path by explosive trail 82 while detonator B is connected to the detonation delay path by explosive trail 83.

Explosive logic switch 86 is connected in series with detonation delay path 81 and is provided with a straight explosive trail 88 and an explosive loop 87 which diverges from straight trail 88. Straight trail 88 is reintersected by explosive loop 87 and then forms a first output trail 94 which is connected to explosive trail 95 and to the A OR B output. First explosive logic switch 86 is provided with a control explosive trail 85 which propagates a detonation signal from detonator B to set switch 86 such that explosive logic switch 86 will only propagate a detonation signal through explosive loop 87. First explosive logic switch 86 is provided with a second output 96 which is formed by explosive loop 87 and connects second explosive logic switch 89 in series with detonation delay path 81 and first explosive logic switch 86.

The second explosive logic switch is constructed with a straight explosive trail 90 and an explosive loop 91 which diverges from straight trail 90 and then reintersects straight trail 90 to form a first output trail 92 which leads to the A AND B output. Straight explosive trail 90 leads into explosive trail 93 and further into explosive trail 95 to form a second output for the second explosive logic switch at the A OR B output. Second explosive logic switch 89 is provided with a control explosive trail 84 which propagates a detonation signal from detonator A to straight explosive trail 90 thus setting the switch to propagate a detonation signal only in explosive loop 91.

Assuming that both detonators A and B initiate in a proper fashion, a detonation signal from detonator A will be propagated in explosive trail 82 and control explosive trail 84, while a detonation signal from detonator B will be propagated in explosive trail 83 and control explosive trail 85. The input detonation signals in explosive trails 82 and 83 will enter detonation delay path 81. The control detonation signals in control explosive trails 84 and 85 will proceed to the second explosive logic switch 89 and first explosive logic switch 86, respectively. The signal in control explosive trail 85 will intersect straight explosive trail 88 and disrupt the trail while the signal in control explosive trail 84 will intersect straight explosive trail 90 and also disrupt the trail thereby setting both the first and second explosive logic switches to propagate detonation signals only in explosive loops 87 and 91, respectively. When the detonation signal which has been delayed in detonation delay path 81 exits the delay path, it will enter the first explosive logic switch and be unable to propagate down straight explosive trail 88 which has been previously interrupted. The detonation signal will instead propagate down explosive loop 87 and enter the second explosive logic switch where it will propagate on explosive loop 91 to explosive trail 92. The detonation signal will then output at the A AND B output signifying that both detonator A and B have initiated properly.

If for any reason one of the detonators, either A or B, fail to initiate properly, the corresponding explosive logic switch will not be set and the detonation signal exiting from detonation delay path 81 will be shunted into the A OR B output. Assuming that detonator B fails to initiate, a detonation signal will not be propagated in control explosive trail 85 and will not interrupt straight explosive trail 88 of first logic switch 86. When the detonation signal exits detonation delay path 81, it will propagate down straight explosive trail 88 in less time than it will propagate around explosive loop 87 and thus reach the intersection of straight explosive trail 88 and explosive loop 87 and disrupt the intersection and proceed into explosive trail 94 which joins trail 95 and leads to the A OR B output. It is to be understood that a similar course of events will take place if detonator B initiates properly but detonator A fails to initiate. If detonator A fails to initiate then a detonation signal will not propagate down control explosive trail 84 to disrupt straight explosive trail 90 and set second logic switch 89, again shunting the detonation signal into the A OR B output.

Referring now to FIG. 9, there is illustrated a second generation asynchronous logic safing device which incorporates the AND/OR logic gate of FIG. 8 and the AND gate of FIG. 6 to yield a simplified safing device which is mappable on a single surface and thus requires no multi-surface mechanical interfaces. Explosive safing device 100 is configured to require that at least 4 out of 5 detonators initiate properly before an output signal is generated from the safing device to the booster charge and warhead.

Safing device 100 is constructed with a plurality of paired detonators, here illustrated as pairs 1, 2 and 3, 4. Detonators 1 and 2 are connected in series with AND/OR logic gate 101 while detonators 3 and 4 are connected in series with AND/OR logic gate 102. Gate 101 is connected to detonator 1 by explosive trail 103 and to detonator 2 by explosive trail 104. Gate 102 is connected to detonator 3 by explosive trail 105 while detonator 4 is connected by explosive trail 106. It is to be understood that AND/OR logic gates 101 and 102 are constructed in accordance with the logic gate illustrated in FIG. 8 as described above. To aid in illustrating the device components, AND/OR gates in FIGS. 9 and 11 are further labeled with the "&/" symbol. Gate 101 is provided with an AND output explosive trail 107 and an OR output explosive trail 108. Gate 102 is provided with an AND output explosive trail 110 and an OR output explosive trail 114. A detonation signal propagated on AND explosive trail 107 signifies that both detonators 1 and 2 have initiated properly while a detonation signal on OR explosive trail 108 signifies that only one of the paired detonators 1 or 2, have initiated properly. A detonation signal propagated on AND explosive trail 110 signifies that both detonators 3 and 4 have initiated properly while a detonation signal propagated on OR explosive trail 114 signifies that only one of the paired detonators 3 or 4, have initiated in a proper fashion.

As illustrated in FIG. 9, safing device 100 is also furnished with an outlet AND gate 116 which is connected in series with both AND/OR logic gates 101 and 102. AND gate 116 receives inputs from AND explosive trail 107 and AND explosive trail 110. It is to be understood that AND gate 116 is configured in accordance with the AND logic gate previously described in reference to FIG. 6. Outlet AND gate 116 is provided with an output explosive trail 123 which is connected in series with outlet 124. When AND gate 116 receives input signals from AND explosive trails 107 and 110, an output detonation signal is generated in explosive trail 123 and propagate to outlet 124 signifying that detonators 1, 2, 3 and 4 have initiated properly.

Safing device 100 is further provided with secondary AND gates 115 and 117. Secondary AND gate 115 receives an AND input from explosive trail 109 which is connected to AND explosive trail 107 of AND/OR gate 101 to provide a detonation signal to secondary AND gate 115 when both detonators 1 and 2 have initiated properly. Secondary AND gate 115 is also provided with an OR input by means of explosive trail 114 of AND/OR logic gate 102.

Secondary AND gate 117 is provided with an AND input by explosive trail 111 which is connected to AND explosive trail 110 of AND/OR logic gate 102. Propagation of a detonation signal on explosive trail 111 signifies that detonators 3 and 4 have initiate properly. Secondary AND gate 117 is also provided with an OR input by means of OR explosive trail 108 of AND/OR logic gate 101.

Referring again to FIG. 9 it can be seen that safing device 100 is also provided with an additional detonator, here designated as detonator 5, which is connected in series by explosive trail 120 with an additional AND gate 121. Additional AND gate 121 thus receives an input if detonator 5 initiates properly. Secondary AND gate 115 is provided with an output explosive trail 119 which is connected in series with additional AND gate 121. Secondary AND gate 117 is provided with output explosive trail 118 which Joins explosive trail 119 and also connects secondary AND gate 117 in series with additional AND gate 121. Thus, either secondary AND gate 115 or secondary AND gate 117 furnish a second input for additional AND gate 121. An output explosive trail 122 connects additional AND gate 121 in series with explosive outlet 124.

Assuming that detonators 1 through 4 initiate properly, detonation signals will be propagated in explosive trails 103, 104, 105 and 106 to AND/OR logic gates 101, and 102, respectively. Logic gate 101, upon receipt of detonation signals from both detonators 1 and 2 will generate an output detonation signal on AND explosive trail 107 to outlet AND gate 116. A detonation signal will also be propagated in explosive trail 109 to secondary AND gate 115, however, this signal will be extinguished in the secondary AND gate because secondary AND gate 115 will not receive an OR input detonation signal on explosive trail 114. AND/OR logic gate 102, upon receipt of signals from detonators 3 and 4 will generate an output detonation signal in AND explosive trail 110 which will also serve as an input to outlet AND gate 116. A detonation signal will also be propagated in explosive trail 111, however, this signal will be extinguished in secondary AND gate 117 because secondary AND gate 117 will not receive an OR input detonation signal on explosive trail 108.

When outlet AND gate 116 receives the inputs from explosive trails 107 and 110, an output detonation signal will be generated in output explosive trail 123 and propagated to outlet 124. The detonation signal at outlet 124 will signify that detonators 1 through 4 have initiated properly. With the detonation of detonators 1 through 4 in a proper fashion, it is immaterial whether or not detonator 5 initiates properly because the requirement that at least 4 out of 5 detonators initiate has already been satisfied. The detonation signal which outlet 124 receives will be propagated on to the booster charge or warhead (not shown). The symbols in parenthesis adjacent a trail indicates the combination of functioning detonators which will produce a signal in a given trail.

Figure 10:
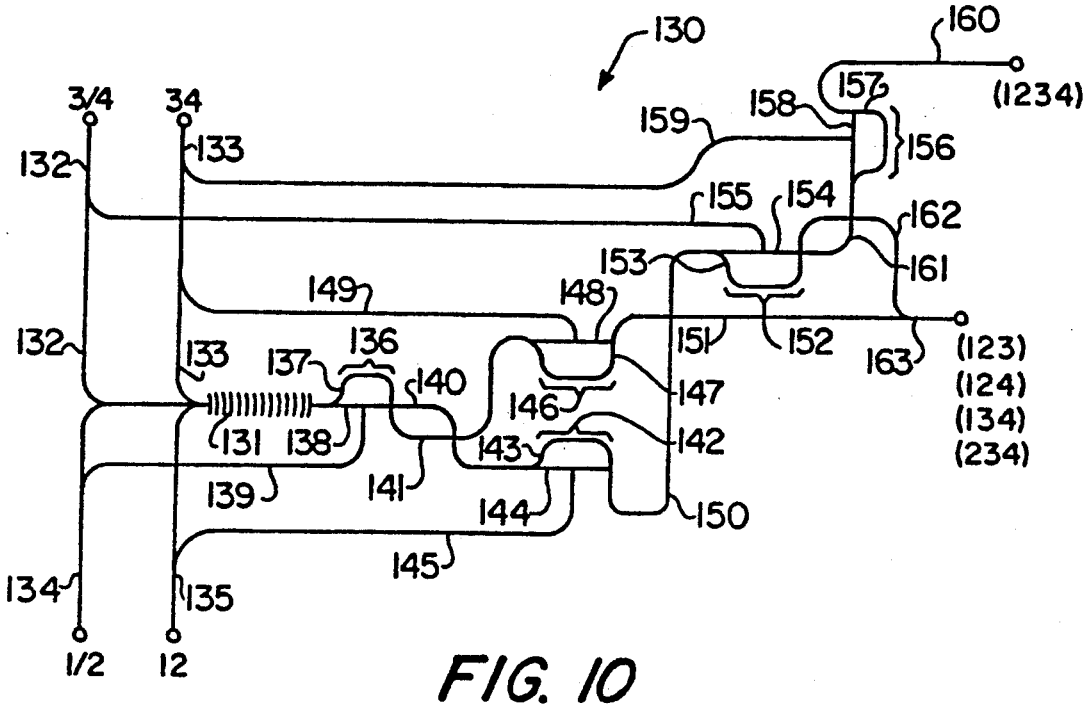
FIG. 10 illustrates a complex explosive logic gate.

Referring now to FIG. 10, there is illustrated in schematic form a complex logic gate which generates an output detonation signal when at least 3 out of 4 detonators initiate properly. The complex logic gate receives detonation signal inputs from AND/OR logic gates (not shown) such as those illustrated in FIG. 8. Complex logic gate 130 is constructed with a detonation delay path 131 in series with a primary explosive logic switch 136. Detonation delay path 131 receives detonation signal inputs from a first AND/OR logic gate and a second AND/OR logic gate (not shown) with a first OR detonation signal input being propagated on explosive trail 132, a first AND detonation signal input being propagated on explosive trail 133, a second OR detonation signal input being propagated on explosive trail 134, and a second AND detonation signal input being propagated on explosive trail 135. Primary explosive logic switch 136 is constructed with a straight explosive trail 138 and an explosive loop 137 which diverges from straight explosive trail 138 and then reintersects trail 138 and continues into a second output explosive trail 141. Straight explosive trail 138 of primary logic switch 136 continues on after intersecting explosive loop 137 to form first output explosive trail 140. Primary explosive logic switch 136 is provided with control explosive trail 139 which intersects straight explosive trail 138 and is also connected to explosive trail 134 so as to propagate a second OR detonation signal to primary explosive logic switch 136 and set the switch for detonation propagation only in explosive loop 137.

Complex logic gate 130 is further provided with a pair of secondary explosive logic switches 142 and 146 with secondary explosive logic switch 142 connected in series with primary explosive logic switch 136 by first output explosive trail 140. Secondary explosive logic switch 146 is also connected in series with primary explosive logic switch 136 by means of second output explosive trail 141.

Secondary explosive logic switch 142 is constructed with a straight explosive trail 144 and an explosive loop 143 which diverges from trail 144 and then reintersects trail 144. A control explosive trail 145 intersects straight explosive trail 144 and also connects to explosive trail 135 so as to propagate a second AND detonation signal to set secondary explosive logic switch 142 for detonation propagation only in explosive loop 143. Explosive loop 143 leads into output explosive trail 150 which propagates an output detonation signal when secondary explosive logic switch 142 is set by explosive trail 145.

Secondary explosive logic switch 146 is constructed with straight explosive trail 148 and explosive loop 147 which diverges from trail 148 and then reintersects trail 148 before leading into output trail 151. A control explosive trail 149 intersects straight explosive trail 148 and also connects to explosive trail 133 so as to propagate a first AND detonation signal and set secondary explosive logic switch 146 for detonation propagation only in explosive loop 147. Output explosive trail 151 of secondary explosive logic switch 146 connects with outlet explosive trail 163.

As illustrated in FIG. 10, complex logic gate 130 is further provided with tertiary logic switch 152 which is connected in series with secondary explosive logic switch 142 by means of output explosive trail 150. Tertiary explosive logic switch 152 is provided with a straight explosive trail 154 and an explosive loop 153 which diverges from trail 154 and then reintersects trail 154 before leading into a first output explosive trail 162 which in turn leads to outlet trail 163. Straight explosive trail 154 after intersecting with explosive loop 153 leads into second output explosive trail 161. Tertiary explosive logic switch 152 is also furnished with a control explosive trail 155 which intersects straight explosive trail 154 and connects to explosive trail 132 so as to propagate a first OR detonation signal to set tertiary explosive logic switch 152 for detonation propagation only in explosive loop 153.

As is further illustrated in FIG. 10, complex logic gate 130 is provided with an outlet explosive logic switch 156 which is connected in series with tertiary explosive logic switch 152 by means of second output explosive trail 161 and outlet explosive trail 160. Outlet explosive logic switch 156 is constructed with a straight explosive trail 158 and an explosive loop 157 which diverges from straight explosive trail 158 and then reintersects trail 158 before passing on to outlet trail 160. Outlet explosive logic switch 156 is provided with a control explosive trail 159 which intersects explosive trail 158 and is connected to explosive trail 133 so as to propagate a first AND detonation signal to set outlet explosive logic switch 156 for detonation propagation only in explosive loop 157.

Assuming that detonators 1 through 4 initiate in a proper fashion, a first AND detonation signal will be propagated in explosive trail 133 and a second AND detonation signal will be propagated in explosive trail 135 with the detonation signals entering detonation delay path 131. While the detonation signals from explosive trails 133 and 135 are delayed in delay path 131, detonation signals will also be propagated in control explosive trails 159, 149, and 145 to set outlet explosive logic switch 156 and secondary explosive logic switches 146 and 142, respectively. Because a detonation signal has not been propagated in explosive trails 132 and 134, the tertiary explosive logic switch and the primary explosive logic switch 136 will not be set for detonation propagation in their respective explosive loops.

When the detonation signal exits detonation delay path 131, the signal will propagate down straight explosive trail 138 of primary explosive logic switch 136, and enter first output trail 140, as opposed to exiting explosive loop 137 and entering second output trail 141. The detonation signal in output trail 140 will propagate to secondary explosive logic switch 142 which has been previously set by a detonation signal in control explosive trail 145 The detonation signal will propagate down explosive loop 143 and into output explosive trail 150 and on to tertiary explosive logic switch 152.

Tertiary logic switch 152 has not been set by a detonation signal in control explosive trail 155, therefore allowing the detonation signal propagated in explosive trail 150 to propagate down straight explosive trail 154 and enter the second output trail 161. Explosive trail 161 propagates the detonation signal to outlet explosive logic switch 156 which has been previously set by control explosive trail 159 to propagate the detonation signal in explosive loop 157 to explosive outlet trail 160, signifying that the outlet detonation signal has been generated by the proper initiation of detonations 1 through 4. The symbol (1234) adjacent trail 160 indicates that the output signal on trail 160 is produced by the detonation of detonators 1–4.

Assuming that 1 of the 4 detonators fails to initiate properly and for purposes of explanation detonator 2 will be assumed to have failed, the following course of events will occur in the complex logic gate illustrated in FIG. 10. It is to be understood that a similar course of events would also occur if one of the other detonators failed to initiate properly. If detonator 2 fails to initiate, a detonation signal will be propagated in explosive trail 133 indicating that detonators 3 and 4 initiated properly while a detonation signal will also be propagated in explosive trail 134 indicating that detonator 1 initiated properly but detonator 2 failed to initiate. The detonation signals propagated in explosive trails 133 and 134 will enter detonation delay path 131. Detonation signals will also be propagated from explosive trail 133 to control explosive trail 159 and control explosive trail 149 thereby setting the outlet explosive logic switch 156 and secondary explosive logic switch 146 for detonation propagation in their respective explosive loops, loop 157 and loop 147. Explosive trail 134 will also propagate a detonation signal in control explosive trail 139 for setting of the primary explosiVe logic switch for detonation propagation in explosive loop 137.

When a detonation signal exits detonation delay path 131, a signal will be propagated in explosive loop 137 due to the previous interruption of straight explosive trail 138 by control explosive trail 139. The detonation signal will exit primary explosive logic switch 136 on second output explosive trail 141 and proceed to secondary explosive logic switch 146. The secondary explosive logic switch has been previously set for detonation propagation in explosive loop 147 by the detonation signal carried by control explosive trail 149 which interrupted straight explosive trail 148. The detonation signal enters secondary explosive logic switch 146 and is propagated by explosive loop 147 to output explosive trail 151 and then outlet trail 163. The output generated at outlet 163 signifies that at least 3 out of the 4 detonators initiated properly The symbols in parenthesis adJacent trail 3 indicate the combination of functioning detonators which will produce an output signal in a given trail.

It is to be understood that the configuration of complex logic switch 130 requires that at least 3 out of the 4 detonators initiate properly for logic gate 130 to generate an output signal. If only 2 of the 4 detonators initiate, a detonation signal will be extinguished in the complex logic gate.

Referring now to FIG. 11 there is illustrated in schematic form a third generation asynchronous explosive logic safing device which incorporates the complex logic gate of FIG. 10, the AND/OR logic gate of FIG. 8, and the AND logic gate of FIG. 6 to produce a safing device which is simple to construct and mappable on a single surface.

Safing device 170 is constructed with a plurality of paired detonators illustrated as detonators 1 through 4 with detonators 1 and 2 forming a first pair and detonators 3 and 4 forming a second pair. AND/OR logic gates 171 and 172 are connected in series with detonators 1 and 2 and detonators 3 and 4, respectively. AND/OR logic gate 171 is connected to detonator 1 by explosive trail 173 and connected to detonator 2 by explosive trail 174. AND/OR logic gate 172 is connected by explosive trail 175 to detonator 3 and is connected by explosive trail 176 to detonator 4. It is to be understood that AND/OR logic gates 171 and 172 are configured in accordance with AND/OR logic gate 80 described previously in FIG. 8.

AND/OR logic gate 171 is provided with a first AND output trail 177 and a first OR output trail 178 while AND/OR logic gate 172 is provided with a second AND output trail 180 and a second OR output trail 179. Explosive trails 177, 178, 179 and 180 provide input detonation signals for complex logic gate 130. It is to be understood that complex logic gate 130 is configured in accordance with the complex explosive logic gate previously described in reference to FIG. 10.

Complex logic gate 130 is provided with a first output explosive trail 160 that propagates a detonation signal to outlet 186 signifying that detonators 1 through 4 have initiated properly. The complex logic gate is also furnished with a second output explosive trail 163 which propagates a detonation when 3 out of the 4 detonators have initiated properly. If less than 3 detonators initiate in a proper fashion, the detonation signal is extinguished in complex logic gate 130.

As shown in FIG. 11, safing device 170 is also provided with an additional detonator, here designated as detonator 5, which is connected in series with AND logic gate 182 by means of explosive trail 181. The proper initiation of detonator 5 results in a first input signal to AND logic gate 182. AND logic gate 182 is also connected to explosive trail 163 which propagates a detonation signal to AND gate 182 from complex logic gate 130 when 3 out of the 4 detonators 1–4 initiate properly. An output explosive trail 184 connects additional AND gate 182 in series with outlet 186 such that when additional AND gate 182 receives input signals from detonator 5 and explosive trail 163, an output detonation signal is generated on explosive trail 184 and propagated to outlet 186.

Assuming that detonators 1–4 initiate properly, AND/OR logic gates 171 and 172 will propagate detonator signals on AND output explosive trails 177 and 180, respectively. Explosive trails 177 and 180 will furnish input signals to complex logic gate 130 and generate an output detonation signal on output trail 160 signifying that the 4 detonators initiated properly. It is immaterial whether or not detonator 5 initiates properly because the requirement that 4 out of 5 detonators initiate has been satisfied with the initiation of the first 4 detonators.

Assuming that 1 of the first 4 detonators, detonators 1–4, fails to initiate, the following course of events will take place. Assuming that detonator 3 fails to initiate while detonators 1, 2, and 4 initiate properly, detonation signals will be propagated by AND/OR logic gate 171 in AND output explosive trail 177 and by AND/OR logic gate 172 in OR output explosive trail 179. The detonation signal on explosive trail 179 signifies that detonator 3 failed to initiate while detonator 4 initiated properly. The detonation signals on explosive trails 177 and 179 are furnished as inputs to complex logic gate 130 which in turn generates a detonation signal on output explosive trail 163 signifying that 3 out of the first 4 detonators initiated in proper fashion. The signal propagated on explosive trail 163 is furnished as an input to additional AND gate 182. When detonator 5 initiates properly, a detonation signal is propagated down explosive trail 181 and furnished as an input to additional AND gate 182. With the receipt of two input signals, additional AND gate 182 generates an output detonation signal in output explosive trail 184 which is propagated to explosive trail 160. The detonation signal in explosive trail 160 travels to outlet 186 where it is furnished to the booster charge or explosive warhead (not shown). Although detonator 3 was assumed to fail for purposes of explanation, it is to be understood that a similar course of events will occur if any one of the first four detonators fails to initiate.

It is thus apparent that the disclosed generations of asynchronous explosive safing devices provide for the safe arming of explosive charges or warheads with devices which are mappable on a single surface without the requirement for mechanical interfaces necessary in multi-surface devices. The safing devices disclosed are constructed with AND gates, AND/OR gates, and complex logic gates which allow the devices to be inexpensively manufactured and compactly constructed on a single surface.

Many obvious modifications and embodiments of the herein disclosed invention other than those set forth above will readily come to mind to one skilled in the art having the benefit of the teachings presented in the foregoing description and the accompanying drawings of the subject invention and hence it is to be understood that such modifications are included within the scope of the appended claims.

I claim:

1. An explosive logic AND gate yielding an explosive output signal when supplied with input signals from first and second detonators, comprising:

delay path means receiving input signals from the first and second detonators;

first logic switch means in series with the delay path means, said first logic switch means capable of being set by a control signal from the first detonator;

second logic switch means in series with the first switch means, said second logic switch means capable of being set by a control signal from the second detonator; and output means in series with the second logic switch means;.

whereby, when the first and second detonators initiate detonation signals, said signals are propagated both as input signals to the delay path means and as control signals to set the first and second logic switch means and allow propagation of the input signals out of the delay path means, through the first and second logic switch means to the output means; and whereby when one detonator fails to initiate, the input signal is extinguished in the logic switch means.

2. The AND gate of claim 1 wherein the first logic switch means is set by a control signal from the second detonator and the second logic switch means is set by a control signal from the first detonator.

3. An explosive logic AND/OR gate yielding a first explosive output signal when supplied with input signals from first and second detonators and yielding a second explosive output signal when supplied with an input signal from either the first or second detonator, comprising:

delay path means receiving input signals from the first and second detonators;

OR output means;

AND output means;

first logic switch means in series with the delay path means, said first logic switch means having two outputs with the selection of the output being controllable by the first detonator, one of the first logic switch means outputs being in series with the OR output means; and second logic switch means in series with the other of the outputs of the first logic switch means, said second logic switch means having two outputs with the selection of the output being controllable by the second detonator, one of the second logic switch means outputs being in series with the OR output means, the other of the second logic switch means outputs being in series with the AND output means;

whereby, when the first and second detonators initiate detonation signals, said signals are propagated both as input signals to the delay path means and as control signals to the first and second logic switch means and allow propagation of the input signals out of the delay path means, through the first and second logic switch means to the AND output means; and when the second detonator fails to initiate, the input signal from the first detonator is propagated out of the delay path means, through the first logic switch means to the OR output means; and also when the first detonator fails to initiate, the input signal at the second detonator is propagated out of the delay path means, through the first and second logic switch means to the OR output means.

4. The AND/OR gate of claim 3 wherein the first logic switch means is controlled by the second detonator and the second logic switch means is controlled by the first detonator.

5. A complex logic gate yielding an explosive output signal when supplied with input signals from a plurality of detonators in relation to a plurality of AND/OR gates and a plurality of AND gates, comprising:

delay path means receiving input signals from the plurality of detonators in relation to the plurality of AND/OR gates and the AND gates, said signals being a first AND input, a second AND input, a first OR input and a second OR input;

first outlet means;

second outlet means;

primary logic switch means in series with the delay path means, said primary switch means having a first primary output means and a second primary output means with the selection of the first primary output means being controllable by the second OR input;

secondary logic switch means in series with the primary logic switch means, said secondary switch means comprising a first logic switch in series with the first primary output means and controllable by the second AND input, and a second logic switch in series with the second primary output means and controllable by the first AND input, said second logic switch having an output in series with the second outlet means;

tertiary logic switch means in series with the second logic switch of the secondary logic switch means, said tertiary switch means having a first tertiary output and a second tertiary output with the selection of the first tertiary output being controllable by the first OR input, said first tertiary output being in series with the second outlet means; and outlet logic switch means in series with the first outlet means and the second tertiary output, said outlet logic switch means being controllable by the first AND input;

whereby, when input detonation signals are provided by the first AND input and second AND input, an outlet detonation signal is generated at the first outlet means; and when input detonation signals are provided by the first AND input and the first OR input, the first AND INPUT and the second OR input, the second AND input and the second OR input or the second AND input and the first OR input an outlet detonation signal is generated at the second outlet means.

6. The complex logic gate of claim 5 wherein the selection of the first primary output means is controllable by the first OR input and the first tertiary output of the tertiary logic switch means is controllable by the second OR input.

7. The complex logic gate of claim 5 wherein the first logic switch of the secondary logic switch means is controllable by the first AND input; and wherein both the second logic switch of the secondary logic switch means and the outlet logic switch means are controllable by the second AND input.

8. An explosive logic safing device for generating an output signal when a given number of a plurality of paired detonators initiate, comprising:

a plurality of AND/OR gate means, each AND/OR gate means of the plurality connected in series with each detonator of an associated pair of detonators, each AND/OR gate means having AND output means and OR output means;

output means; and complex logic gate means in series with the outlet means and the AND and OR output means of each of the plurality of the AND/OR gate means such that when all of the plurality of paired detonators initiate, a first complex logic output signal is generated at the outlet means.

9. The safing device of claim 8 wherein the complex logic gate means comprises:

delay path means capable of receiving input signals from the plurality of AND/OR gate means comprising first and second AND/OR gate means, said signals being a first AND input from the first AND/OR gate means, the first OR input from the first AND/OR gate means, a second AND input from the second AND/OR gate means or a second OR input from the second AND/OR gate means;

primary logic switch means in series with the delay path means, said primary logic switch means having a first primary output means and a second primary output means with the selection of the first primary output means being controllable by the second OR input;

secondary logic switch means in series with the primary logic switch means, said secondary switch means comprising a first logic switch in series with the first primary output means controllable by the second AND input and a second logic switch in series with the secondary primary output means and controllable by the first AND input, said second logic switch having an output in series with the second complex logic gate outlet means;

tertiary logic switch means in series with the second logic switch of the secondary logic switch means, said tertiary switch means having a first tertiary output and a second tertiary output with the selection of the tertiary output being controllable by the first OR input, said first tertiary output being in series with the second complex logic gate outlet means; and outlet logic switch means in series with the first complex logic gate outlet means and the second tertiary output, said outlet logic switch means being controllable by the first AND input;

whereby, when input detonation signals are provided by the first AND input and the second AND input, a complex logic gate detonation signal is generated at the first complex logic gate outlet means and propagated to the outlet means; and when input detonation signals are provided by the first AND input and the first OR input, the first AND input and the second OR input, the second AND input and the second OR input or the second AND input and the first OR input, a complex logic gate detonation signal is generated at the second complex logic gate outlet means and propagated to the additional detonator AND gate means such that when the additional detonator initiates, the additional detonator AND gate means propagates a detonation signal to the outlet means.

10. The safing device of claim 9 wherein the selection of the first primary output means is controllable by the first OR input and the tertiary logic switch means is controllable by the second OR input.

11. The safing device of claim 9 wherein the first logic switch of the secondary logic switch means is controllable by the first AND input and both the second logic switch of the secondary logic switch means and the outlet logic switch means are controllable by the first AND input and the second AND input respectively.

12. An explosive logic safing device provided with a plurality of at least five detonator means for generating an output signal when all but one of the plurality of five detonator means initiate, said device comprising:

first primary AND gate means, a first pair of detonator means of the plurality thereof series connected to the first primary AND gate means, second primary AND gate means, a second pair of detonator means of the plurality thereof series connected to the second primary AND gate means, first secondary AND gate means series connected to the first pair of detonator means and parallel connected to the first primary AND gate means, the first secondary AND gate means being series connected to the second primary AND gate means and being operatively controlled thereby, second secondary AND gate means series connected to the second pair of detonator means and parallel connected to the second primary AND gate means, the second secondary AND gate means being series connected to the first primary AND gate means and operatively controlled thereby, outlet means, outlet AND gate means interposed between the outlet means and the first and second primary AND gate means, the outlet AND gate means being series connected to the outlet means and the first and second primary AND gate means, additional detonator means, and additional detonator AND gate means interposed between the additional detonator means and the first and second secondary AND gate means, the additional detonator AND gate means being series connected to the additional detonator means and the first and second secondary AND gate means and operatively controlled thereby whereby the outlet means of the device provides an output signal when any four detonator means of the additional detonator means and the first and second pairs thereof initiate.

13. An explosive logic safing device provided with a plurality of at least five detonator means for generating an output signal when all but one of the plurality of five detonator means initiate, said device comprising:

first primary AND gate means, a first pair of detonator means of the plurality thereof series connected to the first primary AND gate means, second primary AND gate means, a second pair of detonator means of the plurality thereof series connected to the second primary AND gate means, first secondary AND gate mans series connected to the first pair of detonator means and parallel connected to the first primary AND gate means, the first secondary AND gate means being series connected to the second primary AND gate means and being operatively controlled thereby, first delay means interposed between and interconnected to the first second AND gate means and the first pair of detonator means, second secondary AND gate means series connected to the second pair of detonator means and parallel connected to the second primary AND gate means, the second secondary AND gate means being series connected to the first primary AND gate means and operatively controlled thereby, second delay means interposed between and interconnected to the second secondary AND gate means and the second pair of detonator means, outlet means, outlet AND gate means interposed between the outlet means and the first and second primary AND gate means, the outlet AND gate means being series connected to the outlet means and the first and second primary AND gate means, third delay means interposed between and connected to the second primary AND gate means and the first secondary AND gate means, additional detonator means, additional detonator AND gate means interposed between the additional detonator means and the first and second secondary AND gate means, the additional detonator AND gate means being series connected to the additional detonator means and the first and second secondary AND gate means and operatively controlled thereby whereby the outlet means of the device provides an output signal when any four detonator means of the additional detonator means and the first and second pairs thereof initiate; and fourth delay means interposed between and connected to the second secondary AND gate means and the additional AND gate means.

14. An explosive logic safing device for generating an output signal when all but one of a plurality of at least five detonator means initiate, comprising:

first AND/OR gate means series connected to each one of a first pair of detonator means of the plurality, second AND/OR gate means series connected to each one of a second pair of detonator means of the plurality, each of the first and second AND/OR gate means having AND output means and OR output means, outlet means, outlet AND gate means interposed between and series connected to the outlet means and the AND output means of the first and second AND/OR gate means and being controlled thereby, first and second secondary AND gate means, the first secondary AND gate means being interposed between and series connected to the AND output means of the first AND/OR gate means and the OR output means of the second AND/OR gate means, the second secondary AND gate means being interposed between and series connected to the OR output means of the first AND/OR gate means and the AND output means of the second AND/OR gate means, additional detonator means, additional detonator AND gate means interposed between and series connected to the additional detonator means and the outlet means, said additional detonator AND gate means being connected to and controlled by the first and second secondary AND gate means such that the outlet means provides an output signal when any four detonator means of the additional detonator means and the first and second pairs of detonator means initiate.

15. An explosive logic safing device for generating an output signal when a predetermined number of a plurality of detonators initiate, said device comprising:

a plurality of AND/OR gate means, each AND/OR gate means of the plurality connected in series with each detonator of its associated pair of detonators of the plurality of detonators, each AND/OR gate means having AND output means and OR output means;

outlet means;

complex logic gate means having first outlet means and second outlet means, the first outlet means of the logic gate means being in series with the outlet means and the AND and OR output means of each of the plurality of the AND/OR gate means such that when all pairs of detonators of the plurality initiate, a first complex logic output signal is generated at the outlet means;

additional detonator of the plurality of detonators; and

AND gate means in series with the additional detonator, the outlet means, and the second outlet means of the complex logic gate means; such that when all but one detonator of any pair of detonators of the plurality of detonators initiate, a second complex logic output signal is furnished by the second outlet means of the complex logic gate means to the additional AND gate means; and such that when more than one detonator of the plurality of detonators fails to initiate, the complex logic signal is extinguished in the complex logic gate means.

16. The safing device of claim 15, wherein the plurality of detonators is comprised of five detonators, four of which are arranged in separate pairs.

* * * * *